US007055767B1

(12) United States Patent
Ko

(10) Patent No.: US 7,055,767 B1
(45) Date of Patent: Jun. 6, 2006

(54) SHOWER HEAD STRUCTURE

(75) Inventor: Shi Chia Ko, Changhua Hsien (TW)

(73) Assignee: Chung Cheng Faucet Co., Ltd., Changhua Hsien (TW)

( * ) Notice: Subject to any disclaimer, the term of this patent is extended or adjusted under 35 U.S.C. 154(b) by 0 days.

(21) Appl. No.: 11/056,229

(22) Filed: Feb. 14, 2005

(51) Int. Cl.

| | |
|---|---|
| ***B05B 15/08*** | (2006.01) |
| ***B05B 1/14*** | (2006.01) |
| ***A62C 2/08*** | (2006.01) |
| ***A62C 37/08*** | (2006.01) |
| ***E21F 5/04*** | (2006.01) |

(52) U.S. Cl. ..... 239/587.4; 239/548; 239/391; 239/536; 239/558; 239/587.1; 239/587.3; 4/601

(58) Field of Classification Search ..... 239/587.4, 239/391, 536, 548, 558, 587.1, 587.3, 282, 239/390, 392, 553, 553.3, 553.5, 556, 557, 239/559, 560, 561, 596; 4/601, 605
See application file for complete search history.

(56) References Cited

U.S. PATENT DOCUMENTS 2,681,254 A * 6/1954 Fuller ..... 239/107
5,074,471 A * 12/1991 Baumgarten et al. .... 239/284.1
6,178,570 B1 * 1/2001 Denst et al. ..... 4/541.6
6,899,292 B1 * 5/2005 Titinet ..... 239/548

* cited by examiner

*Primary Examiner*—David A. Scherbel
*Assistant Examiner*—Darren Gorman
(74) *Attorney, Agent, or Firm*—Troxell Law Office PLLC

(57) ABSTRACT

A shower head structure includes a showerhead made up of a main body adjustably mounted to a water outlet coupling tube and rotated in any angles wherein the main body has a limiting separation board properly preset at one side thereof to divide a water-collecting space and a concaved space at both sides thereby, and a plurality of tubular water guiding conduits protruding at preset positions of the limiting separation board thereon to communicate with both the water-collecting space and the water outlet coupling tube thereof. Each of the water guiding conduits is securely registered with a universal connector to which a water outlet spray head with various types of water outlet apertures such as net-like, tubular, or misty water outlet apertures disposed thereon is mounted thereby. Therefore, the water outlet spray heads can be individually and freely adjusted in any angles, permitting the showerhead to deliver water from various angles and in versatile patterns simultaneously for showering purpose, efficiently boosting the interest and function of the present invention in practical use.

5 Claims, 4 Drawing Sheets

SHOWER HEAD STRUCTURE

BACKGROUND OF THE INVENTION

The present invention is related to a shower head structure, including a showerhead made up of a main body adjustably mounted to a water outlet coupling tube and rotated in any angles wherein the main body has a limiting separation board properly preset at one side thereof to divide a water-collecting space and a concaved space at both sides thereby, and a plurality of tubular water guiding conduits protruding at preset positions of the limiting separation board thereon to be securely registered with a plurality of universal connectors each having a water outlet spray head with various types of water outlet apertures disposed thereon mounted thereto. Therefore, the water outlet spray heads can be individually and freely adjusted in any angles, permitting the showerhead to deliver water from various angles and in versatile patterns simultaneously for showering purpose, efficiently boosting the interest and function of the present invention in practical use.

A conventional showerhead is always fixedly secured to a water outlet tube mounted onto a wall, permitting water flow to be discharged directly outwards from the showerhead for showering purpose. As a result, the conventional showerhead is rather limited in practical use, which delivers water flow only in one spray pattern and from a certain fixed angle without the flexibility to verify the spray patterns or adjust the angles as desired. Thus, the conventional showerhead is uncompetitive on the market.

SUMMARY OF THE PRESENT INVENTION

It is, therefore, the primary purpose of the present invention to provide a shower head structure, including a showerhead made up of a main body adjustably mounted to a water outlet coupling tube and rotated in any angles wherein the main body has a limiting separation board properly preset at one side thereof to divide a water-collecting space and a concaved space at both sides thereby, and a plurality of tubular water guiding conduits protruding at preset positions of the limiting separation board thereon to be securely registered with a plurality of universal connectors each having a water outlet spray head mounted thereto; therefore, the water outlet spray heads can be individually and freely adjusted in any angles, permitting the showerhead to deliver water from various angles simultaneously for showering purpose, efficiently boosting the interest and function of the present invention in practical use.

It is, therefore, the second purpose of the present invention to provide a shower head structure wherein each water guiding conduit can be individually engaged with the water outlet spray head having a wide range of water outlet apertures such as net-like, tubular, or misty water outlet apertures disposed thereon so that the showerhead can be variously adjusted to deliver water in versatile patterns and from any angles as desired, achieving the best using status and making it more competitive on the market.

DETAILED DESCRIPTION OF THE PREFERRED EMBODIMENTS

Figure 1:
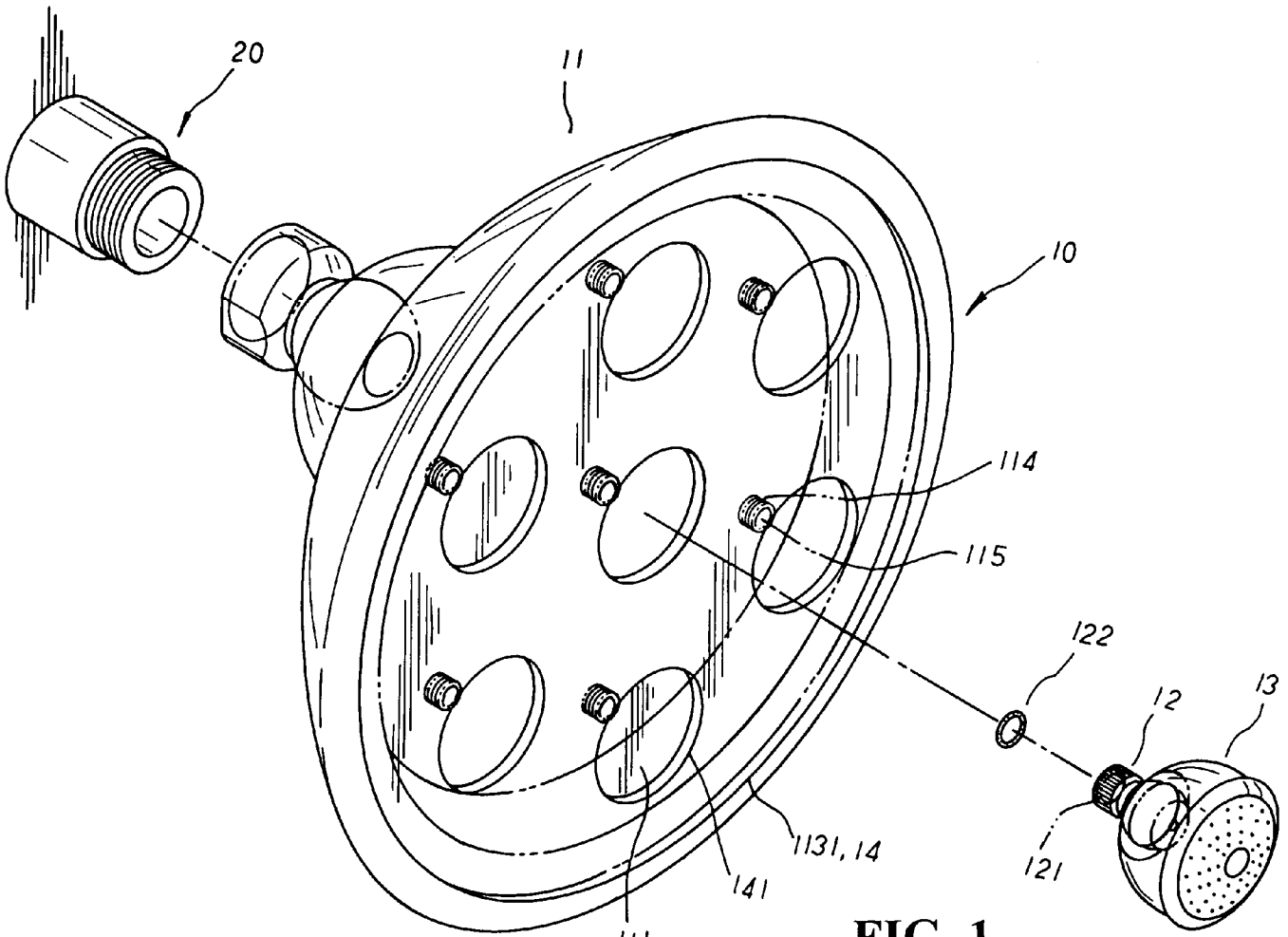
FIG. 1 is an exploded perspective view of the present invention.
Figure 2:
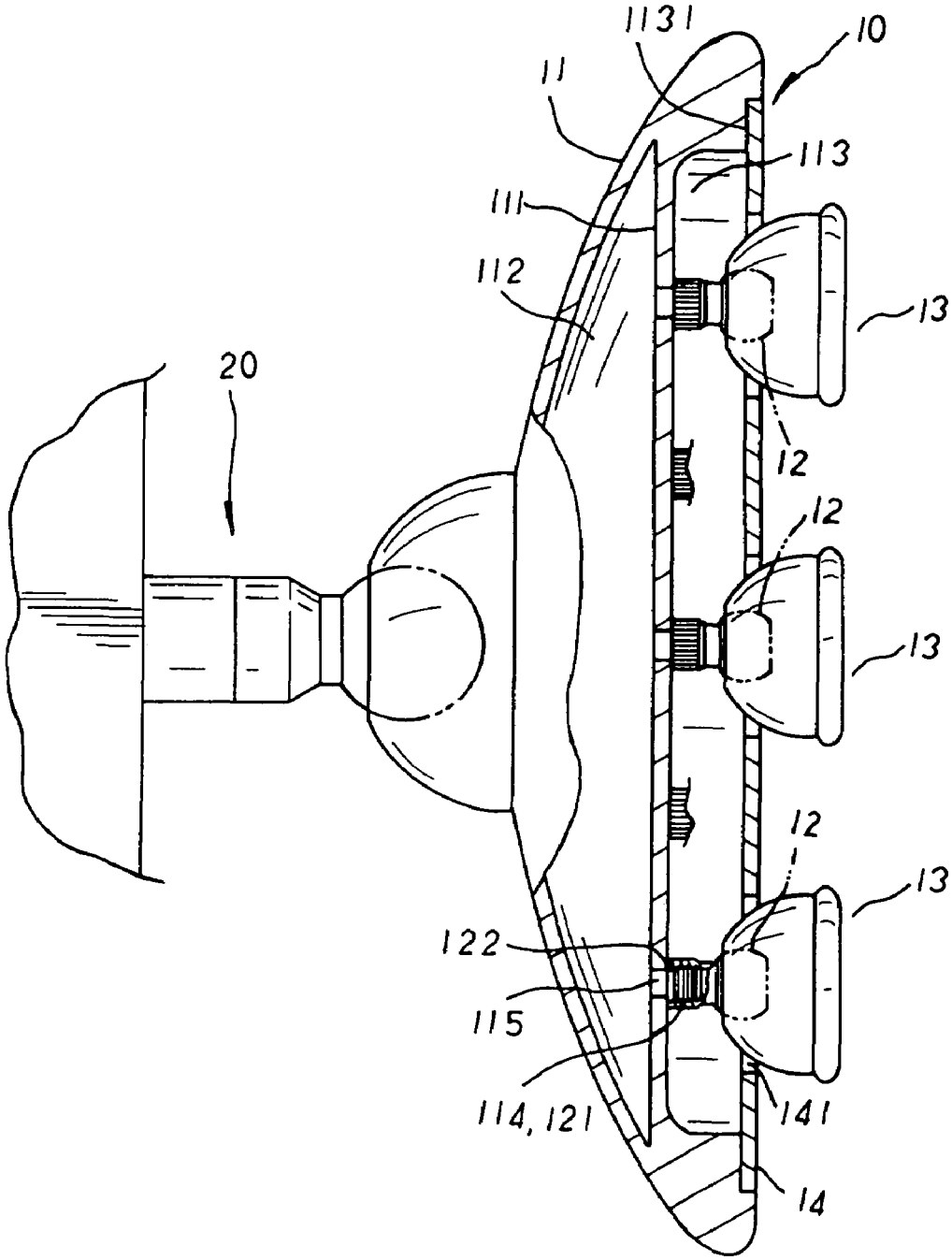
FIG. 2 is a cross sectional view of the present invention in assembly.
Figure 3:
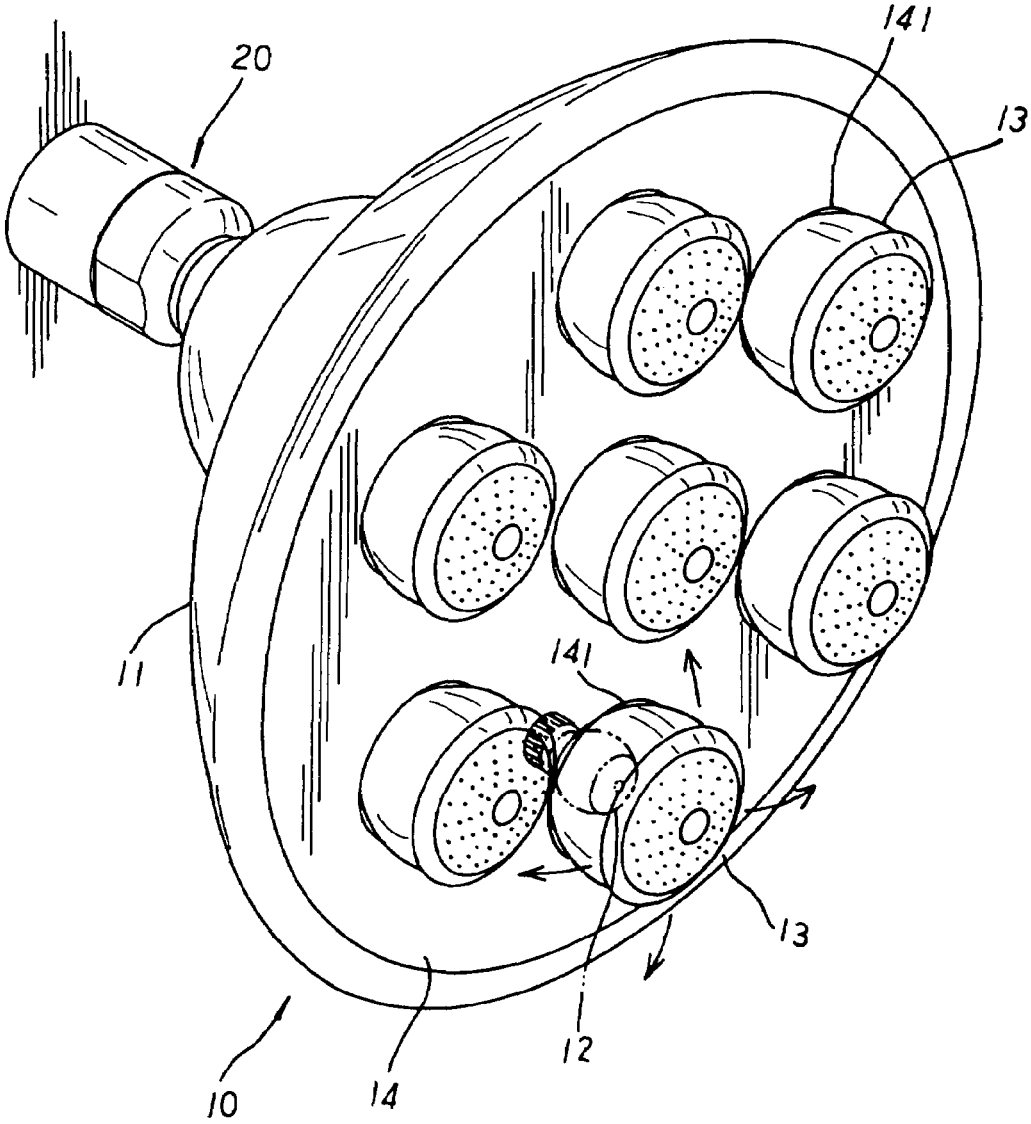
FIG. 3 is a diagram showing the operation of the present invention in practical use.

Please refer to FIGS. 1 to 2 inclusive. The present invention is related to a shower head structure, including a showerhead 10 made up of a main body 11 of a proper size that, adjustably mounted to a water outlet coupling tube 20, can be freely rotated in any angles. The main body 11 has a concaved groove disposed at one side thereof, and a limiting separation board 111 is properly preset at the concaved groove of the main body 11 therein to divide a water-collecting space 112 and a concaved space 113 at both sides thereby. A plurality of tubular water guiding conduits 115 each having external threads 114 disposed thereon are provided protruding at preset positions of the limiting separation board 111 thereon to communicate with both the water-collecting space 112 and the water outlet coupling tube 20 thereof, and a plurality of universal connectors 12 each having internal threads 121 disposed therein and a sealing ring 122 adapted thereto are securely registered with the external threads 114 of the water guiding conduits 115 respectively and abutted tight by the sealing rings 122 to avoid the problem of leakage thereby. A plurality of water outlet spray heads 13 are applied and mounted to the universal connectors 12 with the universal connector 12 of each spray head 13 thereof precisely located at the concaved space 113 therein. At the opening edge of the concaved space 113 thereof is disposed a stepwise and annular inserting seat 1131 for the secure location of a decoration cover 14 therein. At preset positions of the decoration cover 14 are disposed a plurality of positioning slots 141 respectively aligned with the water outlet spray heads 13 thereof, permitting the spray heads 13 to protrude outside the positioning slots 141 thereof. Therefore, the water outlet spray heads 13 can be individually adjusted in any angles at the positioning slots 141 therein, and the showerhead 10 is capable of delivering water from various angles for showering purpose via the spray heads 13 simultaneously adjusted into different angles as desired as shown in FIG. 3, efficiently boosting the interest and function of the present invention in practical use.

Figure 4:
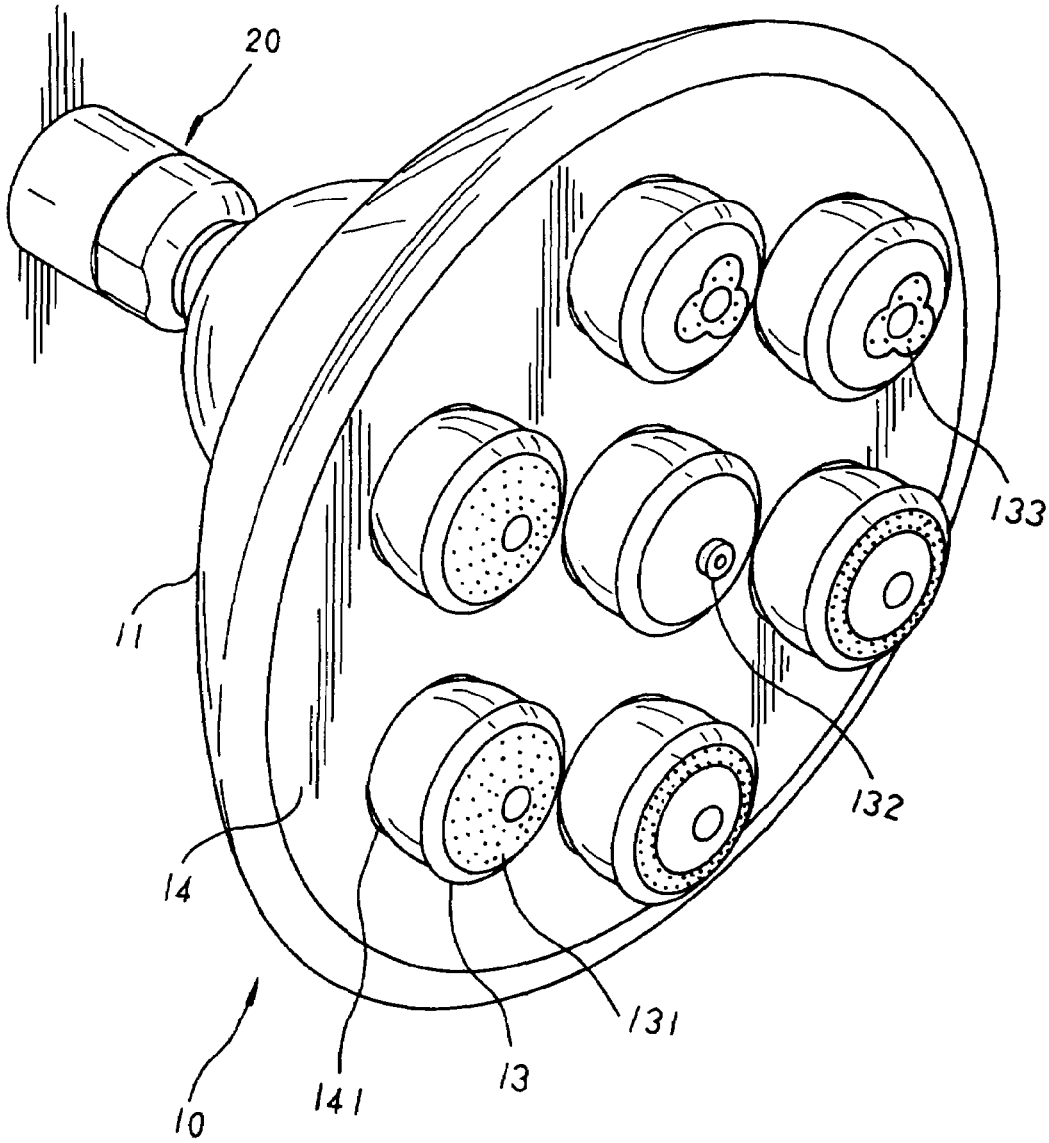
FIG. 4 is another diagram showing the operation of the present invention in use.

Please refer to FIG. 4. Each of the universal connectors 12 fixed to the water guiding conduits 115 thereof can be individually engaged with the water outlet spray head 13 that is equipped with a wide range of water outlet apertures such as net-like water outlet apertures 131, tubular water apertures 132, and misty water outlet apertures 133, etc. And water flow running through the water-collecting space 112, the water guiding conduits 115 and the universal connectors 12 thereof will come into each of the spray heads 13 and deliver outwards there-from in versatile spray patterns depending on the various types of water outlet apertures like the net-like water outlet apertures 131, the tubular water apertures 132, and the misty water outlet apertures 133, etc. via which the water flow is discharged outwards accordingly. Thus, the showerhead 10 of the present invention can be freely and variously adjusted in angles and the patterns of water delivery as desired, efficiently achieving the best using status and making it more competitive on the market.

What is claimed is:

1. A shower head structure, including a showerhead made up of a main body adjustably mounted to a water outlet coupling tube and rotated in any angles wherein the main body has a limiting separation board properly preset at one side thereof to divide a water-collecting space and a concaved space at both sides thereby, and a plurality of water guiding conduits protruding at preset positions of the limiting separation board thereon to communicate with both the water-collecting space and the water outlet coupling tube thereof; each water guiding conduit is securely registered with a universal connector to which a water outlet spray head is mounted thereby; therefore, the water outlet spray heads can be individually adjusted in any angles, permitting the showerhead to deliver water from various angles simultaneously for showering purpose via the spray heads freely adjusted into different angles as desired, efficiently boosting the interest and function of the present invention in practical use.

2. The shower head structure according to claim 1 wherein at the opening edge of the concaved space disposed at one side of the main body thereof is disposed a step-wise and annular inserting seat for the secure location of a decoration cover therein, and at preset positions of the decoration cover are disposed a plurality of positioning slots respectively aligned with the water outlet spray heads thereof, permitting the spray heads thereof to protrude outside the positioning slots thereof.

3. The shower head structure according to claim 1 wherein each of the universal connectors fixed to the water guiding conduits thereof can be individually engaged with one of a variety of said water outlet spray heads, said variety including outlet spray heads having one of net-like water outlet apertures, tubular water outlet apertures, and misty water outlet apertures, thereby, permitting the showerhead thereof to deliver water flow from the spray heads in versatile spray patterns accordingly.

4. The shower head structure as claimed in claim 1 wherein each water guiding conduit thereof has external threads defining thereon to be registered with internal threads defining the interior of each universal connector for secure mutual engagement thereby.

5. The shower head structure as claimed in claim 1 wherein each water guiding conduit is made in a tubular shape.

* * * * *